US009718276B2

(12) United States Patent
Tomoguchi

(10) Patent No.: US 9,718,276 B2
(45) Date of Patent: Aug. 1, 2017

(54) SET OF TANK AND BOTTLE, AND BOTTLE

(71) Applicant: BROTHER KOGYO KABUSHIKI KAISHA, Nagoya-shi, Aichi-ken (JP)

(72) Inventor: Suguru Tomoguchi, Okazaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 37 days.

(21) Appl. No.: 14/858,669

(22) Filed: Sep. 18, 2015

(65) Prior Publication Data

US 2016/0121619 A1 May 5, 2016

(30) Foreign Application Priority Data

Oct. 31, 2014 (JP) ..... 2014-222262

(51) Int. Cl.
*B41J 2/175* (2006.01)
*B41J 29/13* (2006.01)

(52) U.S. Cl.
CPC ..... *B41J 2/17553* (2013.01); *B41J 2/1752* (2013.01); *B41J 2/17509* (2013.01); *B41J 2/17513* (2013.01); *B41J 29/13* (2013.01); *B41J 2/17523* (2013.01)

(58) Field of Classification Search
CPC .. B41J 2/17513; B41J 2/1752; B41J 2/17523; B41J 2/17553; B41J 2/175; B41J 2/1753; B01L 3/00; B65B 1/04; B65B 31/00
See application file for complete search history.

(56) References Cited

U.S. PATENT DOCUMENTS 7,387,216 B1 * 6/2008 Smith ..... B01L 3/50825 215/DIG. 3
2010/0294395 A1 * 11/2010 Pretorius ..... B65B 31/003 141/3
2012/0125481 A1 5/2012 Matsumoto et al.
2014/0043408 A1 2/2014 Kudo et al.

FOREIGN PATENT DOCUMENTS

JP 2012-106363 A 6/2012
JP 2013-176968 A 9/2013

* cited by examiner

*Primary Examiner* — Thinh H Nguyen
(74) *Attorney, Agent, or Firm* — Merchant & Gould P.C.

(57) ABSTRACT

There is provided a set of tank and bottle. A tank includes a liquid chamber, an inclined wall and an inlet. A bottle includes a bottle body having a first opening, and a nozzle. The nozzle has: a trunk section fitted onto the end portion of the bottle body; a shoulder section brought into contact with the end portion of the bottle body; and a nozzle section having a second opening formed in a protruded end portion thereof. In a pouring posture of the bottle in which the nozzle section inserted into the inlet is positioned at a periphery of the inlet, an angle defined between a normal line of the inclined wall and an inner surface of the nozzle section is smaller than an angle defined between the normal line and a horizontal line.

20 Claims, 10 Drawing Sheets

SET OF TANK AND BOTTLE, AND BOTTLE

CROSS REFERENCE TO RELATED APPLICATION

The present application claims priority from Japanese Patent Application No. 2014-222262 filed on Oct. 31, 2014 the disclosure of which is incorporated herein by reference in its entirety.

BACKGROUND

Field of the Invention

The present invention relates to a tank configured to store a liquid, a bottle capable of storing the liquid with which the tank is replenished or refilled, and a set of the tank and the bottle.

Description of the Related Art

Conventionally, there is known a liquid consuming apparatus having a tank which is capable of storing a liquid, and a liquid consuming section configured to consume the liquid stored in the tank. Further, there is known a procedure for inserting an end portion of the bottle into an inlet port provided on the tank, and for replenishing or refilling the tank with the liquid stored in the bottle. Furthermore, in the bottle for replenishing the tank with the ink, the body of the bottle storing the liquid therein is configured to include a nozzle which is installed in or attached to the bottle body and via which the liquid inside the bottle body is allowed to flow to the outside the bottle body.

SUMMARY

In the liquid consuming apparatus having the above-described configuration, an inlet is provided, in some cases, on an inclined wall of the tank crossing the horizontal and vertical planes. In such a case, there is such a possibility that, in a pouring posture of the bottle wherein the nozzle is inserted into the inlet, the inclination of the inner surface of the nozzle becomes gradually horizontal and consequently might hinder a flow of the liquid from the bottle toward the tank.

The present teaching has been made in view of the above-described circumstances; an object of the present teaching is to provide a set of a tank and a bottle (hereinafter also referred to as "tank and bottle set") wherein in a case that a liquid is poured or refilled from the bottle to the tank via an inlet provided on an inclined wall of the tank, the flow of the liquid flowing through the nozzle from the bottle toward the tank is smooth.

According to a first aspect of the present teaching, there is provided a set of tank and bottle including:

a tank including a liquid chamber, an inclined wall defining an end of the liquid chamber and inclined relative to a vertical direction, and an inlet formed in the tank penetrating through the inclined wall; and a bottle including a bottle body including a first opening formed in an end portion of the bottle body, and a nozzle configured to be in an attached state to the end portion of the bottle body;

wherein the nozzle includes:

a shoulder section including a contact portion configured to brought into contact with the end portion of the bottle body in the attached state, the shoulder section extending toward an inner side in a radial direction of the first opening of the bottle body; and a nozzle section protruding from an end of the portion of the shoulder section, the nozzle section including an inner surface of which an inner diameter is decreased continuously in a direction away from the shoulder; and wherein in a pouring posture of the bottle in which the nozzle section inserted into the inlet is positioned at a periphery of the inlet, an angle defined between a normal line of the inclined wall and an inner surface of the nozzle section is smaller than an angle defined between the normal line and a horizontal line.

According to the above configuration, since the inner surface of the nozzle section is inclined downward in the direction from the bottle toward the tank in the pouring posture of the bottle, the flow of the liquid from the bottle toward the tank can be made be smooth.

According to a second aspect of the present teaching, there is provided a bottle configured to allow a liquid to be poured therefrom into a tank including liquid chamber, an inclined wall defining an end of the liquid chamber and inclined relative to a vertical direction, and an inlet formed in the tank penetrating through the inclined wall, the bottle comprising:

a bottle body including a first opening formed in an end portion of the bottle body; and a nozzle configured to be in an attached state to the end portion of the bottle body;

wherein the nozzle includes:

a shoulder section including a contact portion configured to brought into contact with the end portion of the bottle body, the shoulder section extending toward an inner side in a radial direction of the first opening of the bottle body; and a nozzle section protruding from an end of the portion of the shoulder section, the nozzle section including an inner surface of which an inner diameter is decreased continuously in a direction away from the shoulder, wherein in a pouring posture of the bottle in which the nozzle section inserted into the inlet is positioned at a periphery of the inlet, an angle defined between a normal line of the inclined wall and an inner surface of the nozzle section is smaller than an angle defined between the normal line and a horizontal line.

According to a third aspect of the present teaching, there is provided a bottle including:

a bottle body including a first opening formed in an end portion of the bottle body, and a nozzle configured to be in an attached state to the end portion of the bottle body;

wherein the nozzle includes a shoulder section including a contact portion configured to brought into contact with the end portion of the bottle body in the attached state, the shoulder section extending toward an inner side in a radial direction of the first opening of the bottle body; and a nozzle section protruding from an end of the portion of the shoulder section, the nozzle section including an inner surface of which an inner diameter is decreased continuously in a direction away from the shoulder section, and wherein the shoulder section is formed with a hole facing the first opening in the attached state, the shoulder section further includes an inner surface which defines the hole and connected to the inner surface of the nozzle section, and a taper ratio of the inner surface of the nozzle section is substantially same as the taper ratio in the inner surface of the shoulder section.

According to the present teaching, the inner surface of the nozzle section is inclined downward in the direction from the bottle toward the tank in the pouring posture of the bottle. Therefore, it is possible to make the flow of the liquid from the bottle toward the tank be smoother.

BRIEF DESCRIPTION OF THE DRAWINGS

FIG. 1A and FIG. 1B are each an external perspective view of a multi-function peripheral 10, wherein FIG. 1A depicts a state that a cover 70 is closed, and FIG. 1B depicts a state that the cover 70 is open.

FIGS. 6A and 6B are each a perspective view of a bottle 80, wherein FIG. 6A depicts a state that a bottle body 81 and a nozzle 90 are separated, and FIG. 6B depicts a state that the nozzle 90 is installed in the bottle body 81.

DESCRIPTION OF THE EMBODIMENTS

An embodiment of the present teaching will be described below. Note that, however, the embodiment described below is merely an example of the present teaching; it goes without saying that it is possible to make any appropriate changes in the embodiment of the present teaching without departing from the gist and scope of the present teaching. Further, note that in the following explanation, a movement (advancement) from the start point to the end point of an arrow is expressed as "orientation" or "-ward" (such as upward, downward, leftward and rightward, frontward, rearward), and unidirectional or bidirectional movement along a line connecting the start and end points of the arrow is expressed as "direction". Namely, the "-ward" is a component of the direction. Upward and downward are each a component of an up-down direction 7 and are opposite to each other; leftward and rightward are each a component of a left-right direction 9 and are opposite to each other; and frontward and rearward are each a component of a front-rear direction 8 and are opposite to each other. Furthermore, in the embodiment, the up-down direction 7 corresponds to the vertical direction, and each of the front-rear direction 8 and the left-right direction 9 corresponds to the horizontal direction.

Figure 1A:
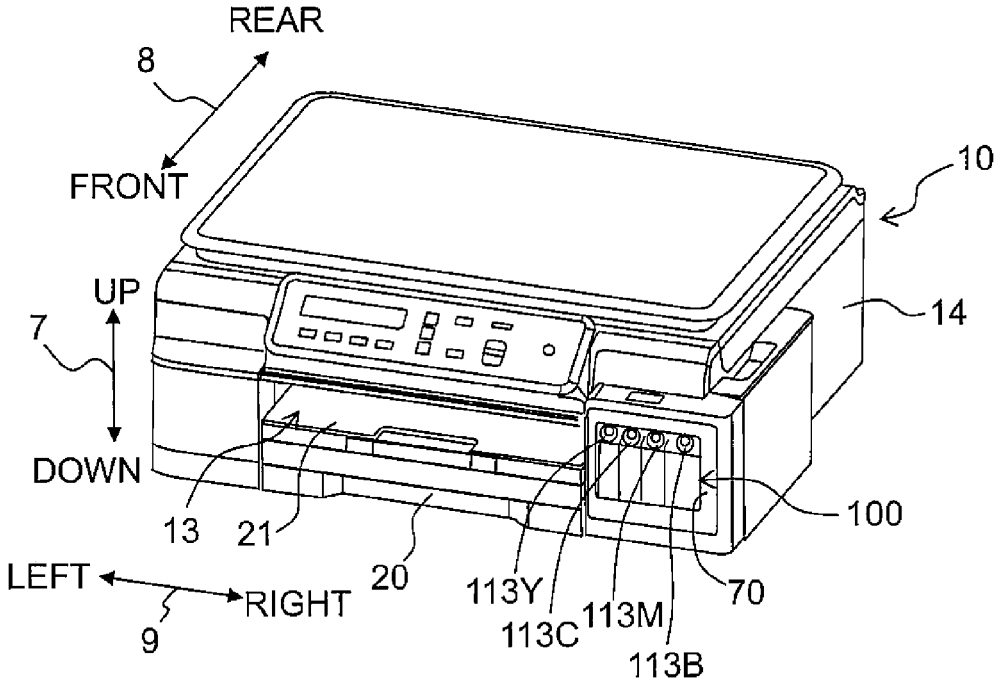
Figure 1B:
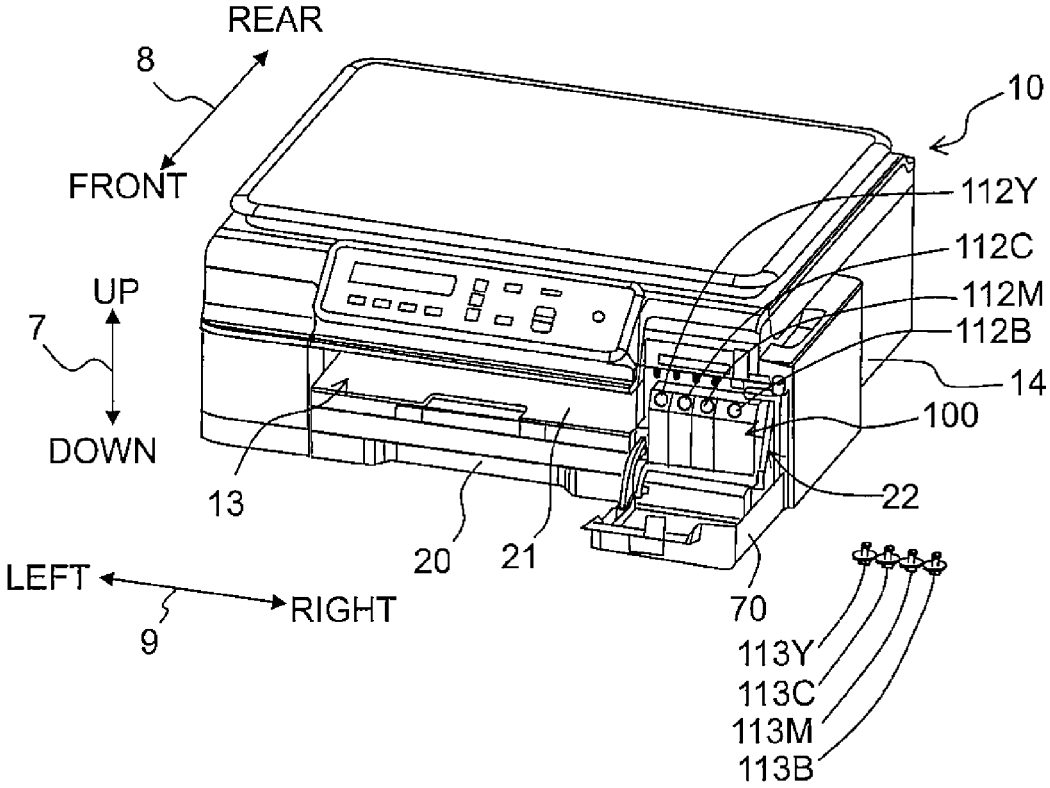

Moreover, the up-down direction 7 is defined with a state that a multi-function peripheral 10 is usably installed or a posture in which the multi-function peripheral 10 is usably installed, as the reference. Further, the front-rear direction 8 is defined such that a side on which an opening 13 of the multi-function peripheral 10 is provided is designated as the frontward side (front surface or front side), and the left-right direction 9 is defined as viewing the multi-function peripheral 10 from the frontward side (front surface). Note that the state that the multi-function periphery 10 is usably installed as depicted in FIGS. 1A and 1B will be referred to as a "usable state". Further, the posture in which the multi-function peripheral 10 is usably installed as depicted in FIGS. 1A and 1B will be referred to as a "usable posture".

<Overall Configuration of Multi-Function Peripheral 10>

As depicted in FIGS. 1A and 1B, the multi-function peripheral 10 is formed to have a substantially rectangular parallelepiped shape. The multi-function peripheral 10 includes, at a lower portion of a casing 14 of the multi-function peripheral 10, a printer unit 11 which records an image onto a paper 12 (see FIG. 2) by an ink jet recording method. The casing 14 includes an exterior member constructing the exterior of the multi-function peripheral 10 and a frame constructing the framework of the multi-function periphery 10. Note that the respective components or parts (to be described later on) of the printer unit 11 are supported by the frame. Further, the frame and the respective components or parts of the printer unit 11 are covered by the exterior member.

Figure 2:
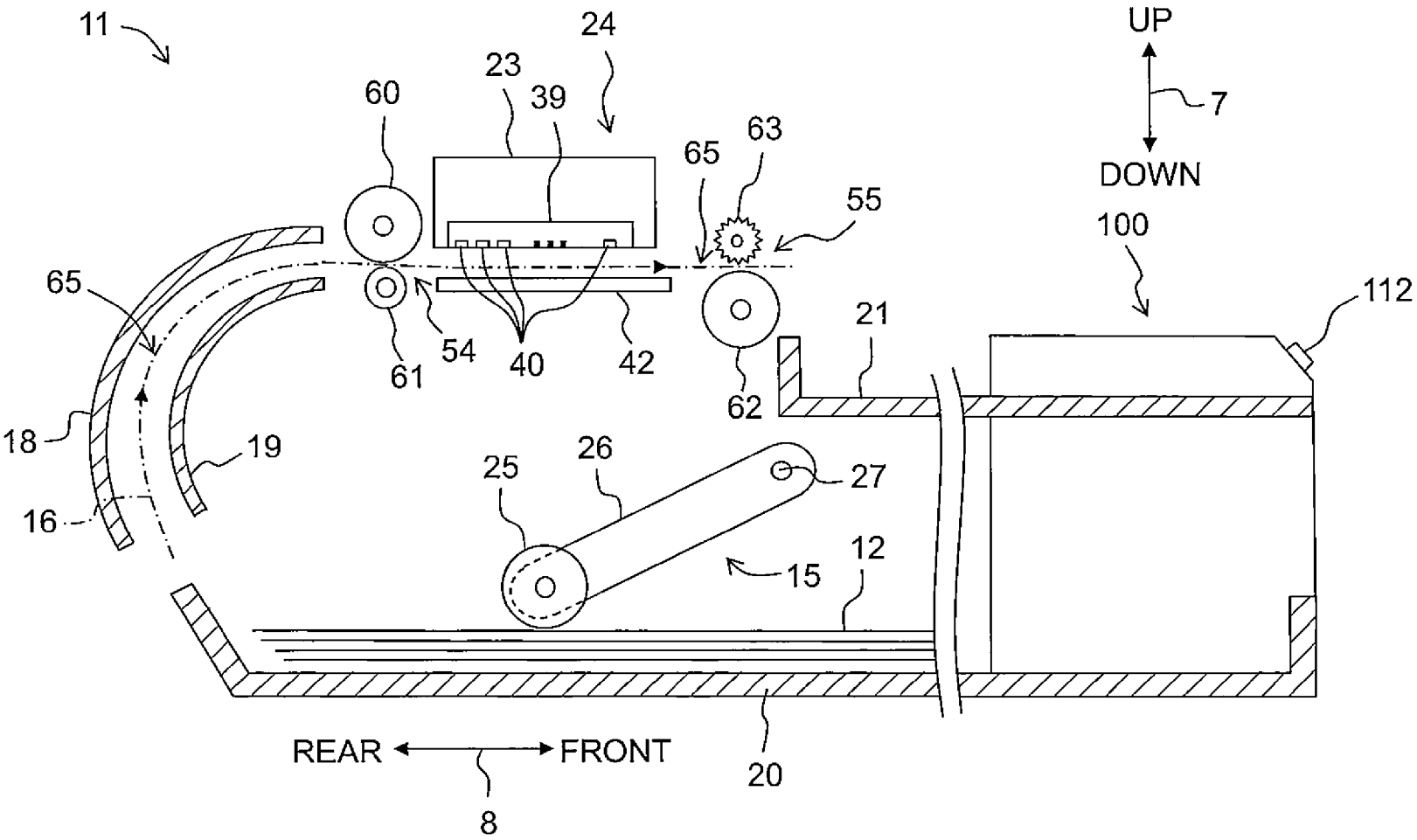
FIG. 2 is a vertical cross-sectional view schematically depicting the internal structure of a printer unit 11.

As depicted in FIG. 2, the printer unit 11 includes a feeding section 15, a feeding tray 20, a discharge tray 21, a conveyance roller section 54, a recording section 24, a discharge roller section 55, a platen 42, and an ink tank 100 (an example of a tank). Further, the multi-function peripheral 10 has various functions such as a facsimile function and a print function. The multi-function peripheral 10 is an example of a liquid consuming apparatus.

<Feeding Tray 20, Discharge Tray 21>

As depicted in FIGS. 1A and 1B, the feeding tray 20 is inserted into or removed from the multi-function peripheral 10 by a user, in the front-rear direction 8 through the opening 13. The opening 13 is formed in a central portion in the left-right direction 9 of the casing 14 of the front surface of the multi-function peripheral 10. The feeding tray 20 is capable of supporting a plurality of sheets of the paper 12 that are stacked in the feeding tray 20. The discharge tray 21 is arranged at a position at the upper side of the feeding tray 20, and is inserted or removed together with the feeding tray 20. The discharge tray 21 supports the paper 12 discharged through a space between the recording section 24 and the platen 42 by the discharge roller section 55.

<Feeding Section 15>

The feeding section 15 feeds the paper 12 supported by the feeding tray 20 to a conveyance route 65. As depicted in FIG. 2, the feeding section 15 includes a feeding roller 25, a feeding arm 26, and a shaft 27. The feeding roller 25 is rotatably supported by the feeding arm 26 at a front end thereof. The feeding roller 25 rotates in a direction for causing the paper 12 to be conveyed in a conveyance direction 16 when a conveyance motor (not depicted in the drawings) is reversely rotated. In the following description, the rotations of the feeding roller 25, a conveyance roller 60, and a discharge roller 62 in the direction for causing the paper 12 to be conveyed in the conveyance direction 16 are each referred to as "normal rotation". The feeding arm 26 is pivotably supported by the shaft 27 supported by the frame of the printer unit 11. A bias is applied to the feeding arm 26 by an elastic force of a spring or by the self-weight of the feeding arm 26 such that the feeding arm 26 is pivoted and urged toward the feeding tray 20.

<Conveyance Route 65>

Figure 3:
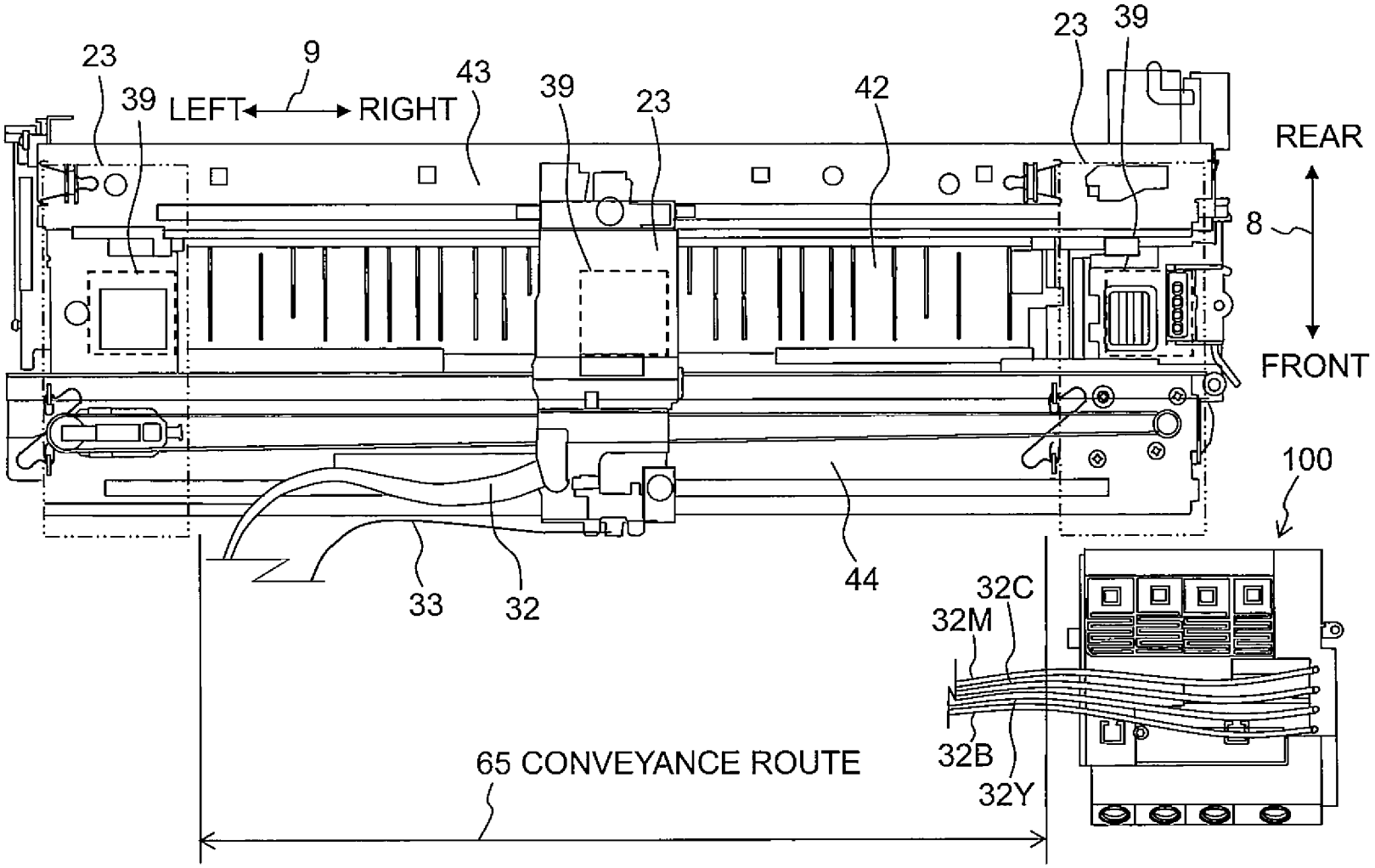
FIG. 3 is a plane view depicting the arrangement of a carriage 23 and an ink tank 100.

As depicted in FIG. 2, in the interior of the printer unit 11, a space is defined by an outer guide member 18 and an inner guide member 19 which are arranged to face with each other with a predetermined gap intervened therebetween. This space constructs a portion of a conveyance route 65. The conveyance route 65 is a route or path that is extended from a rear-end portion of the feeding tray 20 toward the rear side of the printer unit 11. Further, the conveyance route 65 makes a U-turn while being extended from the lower side to the upper side, at the rear side of the printer unit 11; and then the conveyance route 65 reaches the discharge tray 21 via a space between the recording section 24 and the platen 42. As depicted in FIGS. 2 and 3, a portion of the conveyance route 65 between the conveyance roller section 54 and the discharge roller section 55 is provided at a substantially central portion in the left-right direction 9 of the multi-function peripheral 10, and is extended in the front-rear direction 8. Note that in FIG. 2, the conveyance direction 16 of the paper 12 in the conveyance route 65 is indicated by an arrow of a dashed-dotted line.

<Conveyance Roller Section 54>

As depicted in FIG. 2, the conveyance roller section 54 is arranged at the upstream side of the recording head 24 in the conveyance direction 16. The conveyance roller section 54 includes the conveyance roller 60 and a pinch roller 61 which are facing each other. The conveyance roller 60 is driven by a conveyance motor. The pinch roller 61 rotates following the rotation of the conveyance roller 60. The paper 12 is conveyed in the conveyance direction 16 by being pinched between the conveyance roller 60 and the pinch roller 61 which are rotated positively by the normal rotation of the conveyance motor.

<Discharge Roller Section 55>

As depicted in FIG. 2, the discharge roller section 55 is arranged at the downstream side of the recording head 24 in the conveyance direction 16. The discharge roller section 55 includes the discharge roller 62 and a spur 63 which are facing each other. The discharge roller 62 is driven by the conveyance motor. The spur 63 rotates following the rotation of the discharge roller 62. The paper 12 is conveyed in the conveyance direction 16 by being pinched between the discharge roller 62 and the spur 63 which are rotated positively by the normal rotation of the conveyance motor.

<Recording Section 24>

As depicted in FIG. 2, the recording section 24 is arranged between the conveyance roller section 54 and the discharge roller section 55 in the conveyance direction 16. Further, the platen 42 and the recording section 24 are arranged to face each other in the up-down direction 7, while sandwiching the conveyance route 65 therebetween. Namely, the recording section 24 is arranged at a position at which the recording section 24 is located above the conveyance route 65 in the up-down direction 7 and at which the recording section 24 faces the conveyance route 65. The recording section 24 includes a carriage 23 and a recording head 39 (an example of a liquid consuming section).

As depicted in FIG. 3, the carriage 23 is supported by guide rails 43 and 44 which are extended respectively in the left-right direction 9, at positions separated respectively in the front-rear direction 8. The guide rails 43 and 44 are supported by the frame of the printer unit 11. The carriage 23 is connected to a known belt mechanism disposed on the guide rail 44. The belt mechanism is driven by a carriage motor (not depicted in the drawings). Namely, the carriage 23 connected to the belt mechanism reciprocates in the left-right direction 9 by being driven by the carriage motor. As depicted by alternate long and short dash lines in FIG. 3, the range of movement of the carriage 23 spans beyond the left and right end sides of the conveyance route 65 in the left-right direction 9.

Further, an ink tube 32 which connects the ink tank 100 and the recording head 39 and a flexible flat cable 33 which electrically connects the recording head 39 and a control circuit board having a controller (not depicted in the drawings) mounted thereon are extended from the carriage 23. The ink tube 32 supplies an ink stored in the ink tank 100 to the recording head 39. More specifically, four ink tubes 32B, 32M, 32C, and 32Y via which inks of respective colors (which are, for example, black, magenta, cyan, and yellow colors) are distributed are extended from the ink tank 100, and are connected to the carriage 23 in a bundled form. In the following description, these four ink tubes 32B, 32M, 32C, and 32Y will be collectively referred to as "ink tube(s) 32" in some cases. The flexible flat cable 33 transmits a control signal outputted from the controller to the recording head 39.

As depicted in FIG. 2, the recording head 39 is installed on the carriage 23. A plurality of nozzles 40 is formed in the lower surface of the recording head 39. End portions (forward end or tip portions) of the nozzles 40 are exposed from the lower surface of the recording head 39 and from the lower surface of the carriage 23 on which the recording head 39 is installed. In the following description, the surface through which the end portions of the nozzles 40 are exposed will be referred to as a "nozzle surface" in some cases. The recording head 39 jets or discharges the ink as fine ink droplets (minute ink droplets) through the nozzles 40. In a process of movement of the carriage 23, the recording head 39 jets the ink droplets toward the paper 12 supported by the platen 42. Accordingly, an image, etc. is recorded on the paper 12.

<Platen 42>

As depicted in FIGS. 2 and 3, the platen 42 is arranged between the conveyance roller section 54 and the discharge roller section 55 in the conveyance direction 16. The platen 42 is arranged so as to face the recording section 24 in the up-down direction 7, and supports the paper 12, conveyed by the conveyance roller section 54, from therebelow.

<Ink Tank 100>

As depicted in FIGS. 1A and 1B, the ink tank 100 is accommodated in the multi-function peripheral 10. The ink tank 100 is fixed to the casing 14 of the multi-function peripheral 10 such that the ink tank 100 cannot be easily removed from the multi-function peripheral 10. Namely, the ink tank 100 is supported by the casing 14. More specifically, the ink tank 100 is accommodated in the inside of the multi-function peripheral 10 through an opening 22 formed in the front surface of the casing 14, at the right end of the front surface in the left-right direction 9. The opening 22 is adjacent to the opening 13 in the left-right direction 9. Note that, however, the front surface (a base wall 101A and a portion of an inclined wall 101B which will be described later on) of the ink tank 100 is located in front of (ahead of) the opening 22 in the front-rear direction 8 (more specifically, located in front of a portion of the front wall of the casing defining the opening 22).

Further, the multi-function peripheral 10 is provided with a box-shaped cover 70 capable of covering the front surface, of the ink tank 100, located in front of the opening 22. The cover 70 is supported by the casing 14 of the multi-function periphery 10 to be pivotable between a cover position as depicted in FIG. 1A and an exposure position as depicted in FIG. 1B. The cover position is a position at which the cover 70 covers the opening 22 and the front wall 101 of the ink tank 100 from the front side. In other words, the cover position is a position at which the cover 70 covers the opening 22 and the front wall 101 of the ink tank 100 in the front-rear direction 8. The exposure position is a position at which the cover 70 allows the opening 22 and the front wall 101 of the ink tank 100 to be exposed to the outside of the multi-function peripheral 10 and at which the cover 70 does not cover the opening 22 and the front wall 101 of the ink tank 100 (see FIG. 1B).

Figure 4:
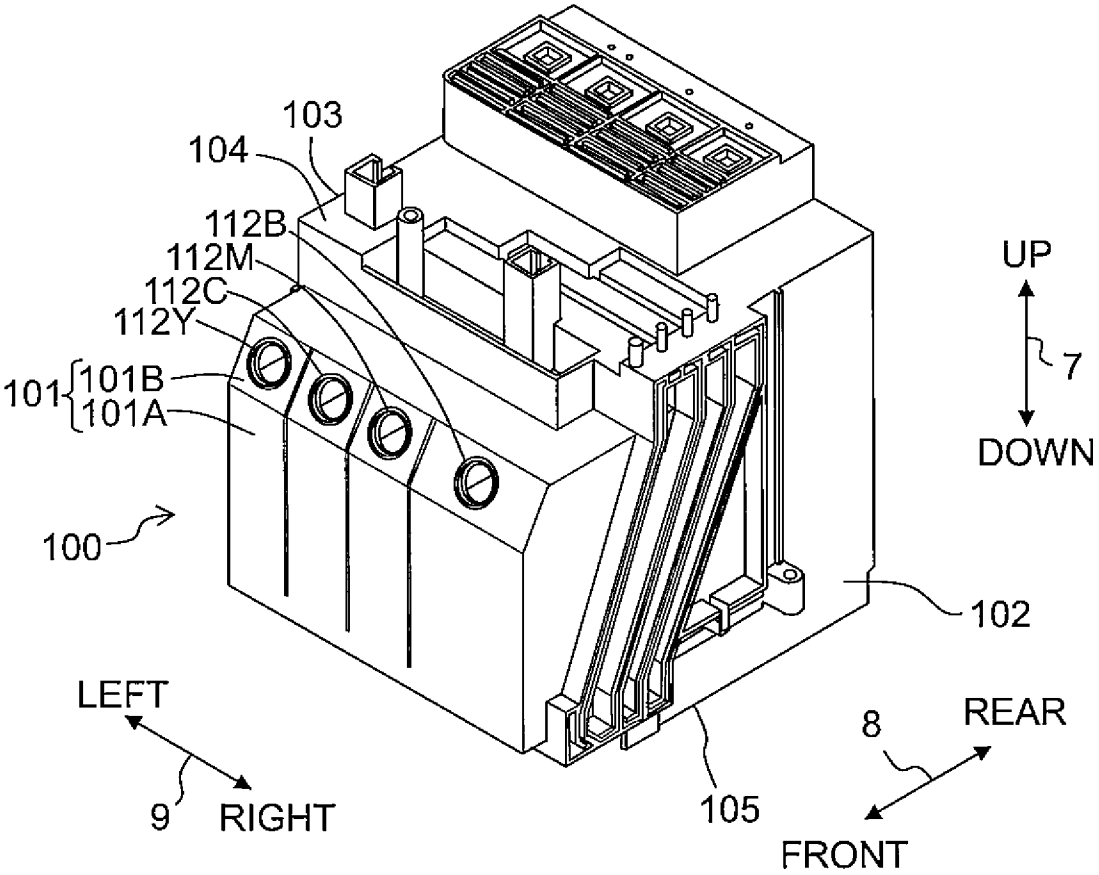
FIG. 4 is a front perspective view of the ink tank 100.
Figure 5:
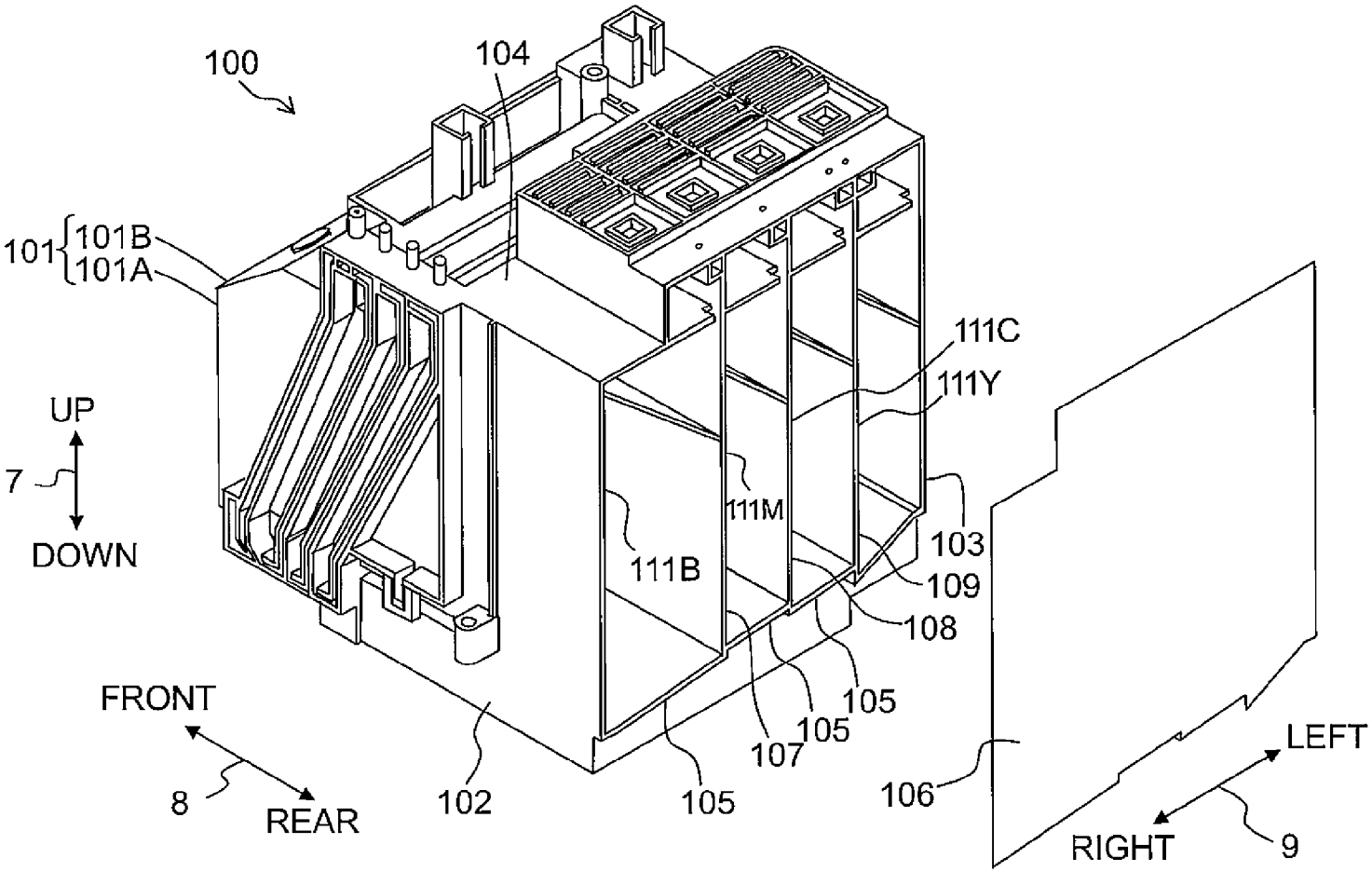
FIG. 5 is a rear perspective view of the ink tank 100.

As depicted in FIGS. 4 and 5, the ink tank 100 has a substantially rectangular parallelepiped shape. The ink tank 100 has a front wall 101, a right wall 102, a left wall 103, an upper wall 104, and a lower wall 105. On the other hand, the rear surface of the ink tank 100 is released or uncovered. Further, by fixing a film 106 by welding to rear-end surfaces of the right wall 102, the left wall 103, the upper wall 104 and the lower wall 105, the rear surface of the ink tank 100 is sealed. Namely, the film 106 forms the rear wall of the ink tank 100. The ink tank 100 having the above-described configuration is formed or shaped as an integrated part or component by, for example, performing injection-molding with a resin material. For example, the inner shape or profile of the ink tank 100 (to be described later on) is defined by an unillustrated mold (metal mold) which is pulled out in the rearward direction from the open or uncovered rear surface of the ink tank 100.

The upper wall 104 defines or demarcates the upper end of an ink chamber 111 in the up-down direction 7. The lower wall 105 defines the lower end of the ink chamber 111 in the up-down direction 7. The front wall 101, the right wall 102 and the left wall 103 are each provided upstandingly between the upper wall 104 and the lower wall 105 in a direction crossing the upper and lower walls 104 and 105. Further, each of the walls 101 to 105 has light transmittance or translucency to such an extent that the ink inside the ink chamber 111 is visible (visually observable or recognizable) from the outside of the ink tank 100.

The front wall 101 is constructed of a base wall 101A extending from the lower wall 105 substantially in the up-down direction 7 and an inclined wall 101B which is connected or continued to the upper end of the base wall 101A and which is inclined relative to the up-down direction 7 and the front-rear direction 8. The inclined wall 101B is inclined rearward relative to the base wall 101A (namely, inclined toward the ink chamber 111). The inclined wall 101B defines an end of the ink chamber 111 and is inclined relative to the vertical direction. Further, the inclined wall 101B is formed with an inlet (inlet port) 112 penetrating the inclined wall 101B in a direction of the thickness of the inclined wall 101B. In the embodiment, although the angle defined between the inclined wall 101B and a horizontal line 121 (see FIG. 7) is less than 45 degrees, the angle may be not less than 45 degrees.

<Ink Chamber 111>

As depicted in FIG. 5, a plurality of partition walls 107, 108 and 109 which define or demarcate the internal space of the ink tank 100 is provided in the interior of the ink tank 100. Each of the partition walls 107, 108 and 109 is extended in the up-down direction 7 and the front-rear direction 8, and is connected to the front wall 101, the upper wall 104, the lower wall 105 and the film 106. Further, the partition walls 107, 108 and 109 are disposed to be separated and away from one another in the left-right direction 9. As a result, the internal space of the ink tank 100 is partitioned into four ink chambers 111B, 111M, 111C and 111Y that are adjacent in the left-right direction 9. The four ink chambers 111B, 111M, 111C and 11Y are each an example of a liquid storage chamber for storing ink to be jetted through the nozzles 40.

The ink chamber 111B is a space demarcated by the front wall 101, the right wall 102, the upper wall 104, the lower wall 105, the film 106 and the partition wall 107. The ink chamber 111M is a space demarcated by the front wall 101, the upper wall 104, the lower wall 105, the film 106 and the partition walls 107 and 108. The ink chamber 111C is a space demarcated by the front wall 101, the upper wall 104, the lower wall 105, the film 106 and the partition walls 108 and 109. The ink chamber 111Y is a space demarcated by the front wall 101, the left wall 103, the upper wall 104, the lower wall 105, the film 106 and the partition wall 109.

In the following description, the ink chambers 111B, 111M, 111C, and 111Y are collectively referred to as "ink chamber(s) 111" in some cases. Further, reference numerals which are similar except for having different alphabetic suffixes (B, M, C, and Y) are assigned to four components provided while corresponding to the ink chambers 111B, 111M, 111C and 111Y, respectively; in a case that these components are collectively referred to, then these components are assigned with a reference numeral(s) while omitting the respective alphabetic suffixes, in some cases.

Inks of different colors are stored in the ink chambers 111, respectively. Specifically, black ink is stored in the ink chamber 111B, cyan ink is stored in the ink chamber 111C, magenta ink is stored in the ink chamber 111M, and yellow ink is stored in the ink chamber 111Y. Each of the color inks is an example of a liquid. However, the number of ink chambers 111 and the colors of the inks are not restricted to the number and the colors in the above-described example. The ink chambers 111 are arranged along the left-right direction 9. Further, among the four ink chambers 111B, 111M, 111C and 111Y, the ink chamber 111B is arranged at the rightmost side and the ink chamber 111Y is arranged at the leftmost side. Furthermore, the ink chamber 111B has a volume larger than the any other ink chambers 111M, 111C and 111Y.

<Inlet 112>

The inclined wall 101B of the ink tank 100 is provided with inlets 112B, 112M, 112C, and 112Y (hereinafter, collectively referred to as "inlet(s) 112" in some cases) for allowing the inks to flow into the ink chambers 111, respectively. The inlet 112 penetrates through the inclined wall 101B in a direction of the thickness of the inclined wall 101B, and makes the corresponding ink chamber 111 communicate with the outside of the ink tank 100. The inner surface of the inclined wall 101B faces the ink chamber 111, and the outer surface of the inclined wall 101B faces the outside of the ink tank 100. The inclined wall 101B is inclined such that the outer surface thereof is located at a position above the inner surface of the inclined wall 101B. Consequently, the inlet 112 allows the ink chamber 111 and the outside of the ink tank 100 to directly communicate with each other. Namely, between the inlet 112 and the ink chamber 111, there is no channel which is bent or curved and which has a cross-sectional area smaller than the cross-sectional area of the inlet 112. Further, it is allowable that the inlet 112 is formed in the upper wall 104, rather than in the inclined wall 101B.

The inclined wall 101B and the inlet 112 provided on the inclined wall 101B are exposed to the outside of the multi-function peripheral 10 when the cover 70 is positioned at the exposure position as depicted in FIG. 1B. Further, the inlet 112 is formed on the inclined wall 101B to be in front of the opening 22. In the present embodiment, the posture of the ink tank 100 when the ink can be poured into the ink chamber 111 through the inlet 112 (pouring posture, refilling posture) coincides with the posture of the ink tank 100 when the multi-function peripheral 10 is in the usable posture. Namely, when the multi-function peripheral 10 is in the usable posture, the ink is poured or refilled into the ink chamber 111 through the inlet 112. Although the inlet 112 is circular-shaped in this embodiment, the shape of the inlet 112 is not limited to this; the inlet 112 may have an elliptical shape, a polygonal shape, etc.

The ink tank 100 has caps 113B, 113M, 113C and 113Y (hereinafter collectively referred to as "cap(s) 113" in some cases) that are detachable and attachable with respect to the inlets 112. As depicted in FIG. 1A, the cap 113 attached to the inlet 112 blocks or closes the inlet 112 by making a tight contact with the periphery of the inlet 112. On the other hand, as depicted in FIG. 1B, in a case that the cap 113 is removed from the inlet 112, the inlet 112 is open or released. The cap 113 is attached to and removed or detached from the inlet 112 in a state that the cover 70 is located at the exposure position. Further, by removing the cap 113 from the inlet 112, the ink can be poured or refilled into the ink chamber 111 via the inlet 112.

Further, each of the ink chambers 111B, 111M, 111C and 111Y is connected to an ink outflow channel (not depicted in the drawings). The ink outflow channel is a channel that allows the ink stored in the corresponding ink chamber 111 to flow out from the ink tank 100. One end of the ink outflow channel is connected to the ink chamber 111 corresponding thereto and the other end of the ink outflow channel is connected to the ink tube 32 corresponding thereto. With this, the ink stored in each of the ink chamber 111 is supplied to the recording head 39 via one of the ink outflow channels and one of the ink tubes 32 corresponding thereto.

Further, each of the ink chambers 111B, 111M, 111C and 111Y is provided with an atmosphere communicating hole (not depicted). The atmosphere communicating hole allows the ink chamber 111 corresponding thereto to communicate with the atmosphere. With this, the internal pressure in each of the ink chambers 111 is maintained at the atmospheric pressure. As a result, it is possible to suppress any excessive supply of the ink due to the increase in internal pressure in the ink chamber 111, or any backflow of the ink due to the decrease in internal pressure in the ink chamber 111, etc. Further, the atmospheric communicating hole is provided, for example, with a semipermeable membrane for preventing any leakage of the ink, etc.

<Bottle 80>

Figure 6B:
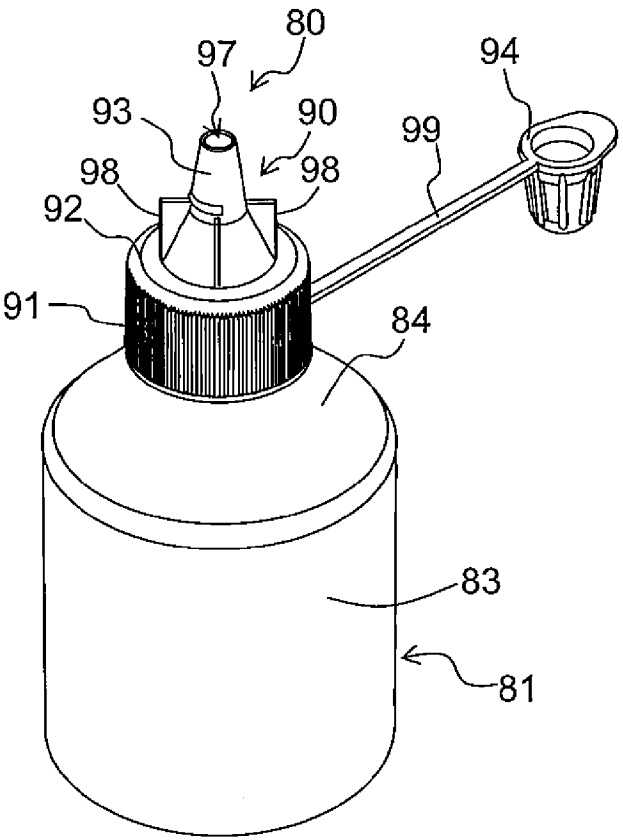
Figure 6A:
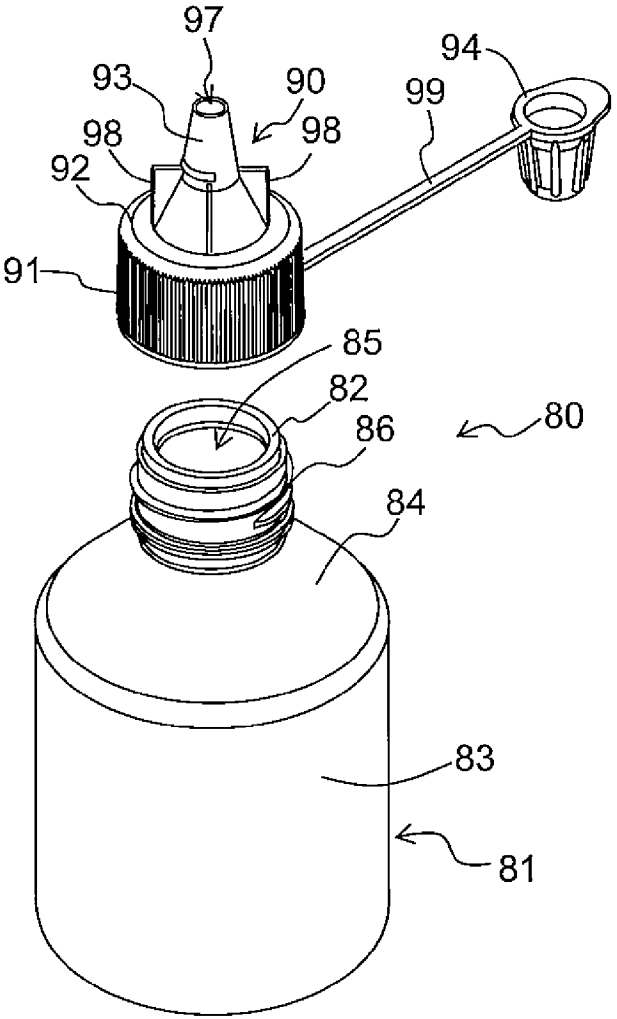

The ink is poured from, for example, a bottle 80 depicted in FIGS. 6A and 6B to the ink chamber 111 of the ink tank 100 via the inlet 112. The bottle 80 is a container configured to store the ink to be refilled to the ink chamber 111. Namely, the bottle 80 stores an ink of any one of the colors that are black, magenta, cyan and yellow. The bottle 80 has a body 81 of the bottle (bottle body 81) and a nozzle 90.

As depicted in FIG. 6A, the bottle body 81 is constructed of a small diameter section 82, a large diameter section 83 and an inclined section 84. A space for storing the ink is defined inside the bottle body 81. In the bottle body 81, one end on a side of the small diameter section 82 is open and the other end on a side of the large diameter section 83 is closed. Further, the small and large diameter sections 82 and 83 are configured to have a substantially circular cylindrical shape. Namely, the bottle body 81 constructs a substantially closed-end circular cylindrical body. Note that, however, the dimension of the inner diameter (inner diameter dimension) of the large diameter section 83 is greater than the dimension of the inner diameter of the small diameter section 82.

The small diameter section 82 has an opening 85 (an example of the first opening) which is formed at one end portion of the small diameter section 82, and the other end portion of the small diameter section 82 is connected to the inclined section 84. Namely, the small diameter section 82 defines the periphery of the opening 85. Further, a male (external) thread 86 (see FIG. 8) is formed on the outer circumferential surface of the small diameter section 82. One end portion of the large diameter section 83 is connected to the inclined section 84, and the other end portion of the large diameter section 83 is closed. The inclined section 84 is inclined from the large diameter section 84 toward the small diameter section 82 such that the dimensions of the inner and outer diameters thereof are continuously decreased. Namely, the inner surface and the outer surface of the inclined section 84 are tapered surfaces toward the small diameter section 82.

As depicted in FIGS. 6A and 6B, the nozzle 90 is configured to be detachable and attachable with respect to the small diameter section 82 of the bottle body 81. The nozzle 90 installed in the small diameter section 82 allows the ink stored in the bottle body 81 to flow to the outside of the bottle 80 therethrough. The nozzle 90 is constructed of a trunk section 91, a shoulder section 92, a nozzle section 93 and a cap section 94.

One end portion of the trunk section 91 is open and the other end portion of the trunk section 91 is connected to an end portion, of the shoulder section 92, on the outer side in the radial direction of the shoulder section 92. The trunk section 91 is configured to have a substantially circular cylindrical shape. Further, a female (internal) thread 95 (see FIG. 8) is formed on the inner circumferential surface of the trunk section 91. The shoulder section 92 is formed to extend from the end portion of the trunk section 91 inwardly in the radial direction. Further, the shoulder section 92 is formed with a through hole 96 (see FIG. 8) penetrating the shoulder section 92 at a central portion thereof in the direction of the thickness of the shoulder section 92. The shoulder section 92 is formed to have a substantially disc shape. Furthermore, in the embodiment, the diameter of the through hole 96 is continuously decreased from the side of the trunk section 91 toward the side of the nozzle section 93. Namely, the inner circumferential surface of the shoulder section 92 is a tapered surface toward the nozzle section 93.

One end portion of the nozzle section 93 is connected to an end portion of the shoulder section 92 on the inner side in the radial direction of the shoulder section 92, and the other end portion of the nozzle section 93 is formed with an opening 97 (an example of the second opening). The nozzle section 93 is formed to protrude from the one end portion on the side of the shoulder section 92 toward the other end portion on the side of (formed with) the opening 97 (in other words, to protrude in a direction away from the trunk section 91) such that the dimensions of the inner and outer diameters of the nozzle section 93 are continuously decreased. Namely, the inner surface of the nozzle section 93 is a tapered surface toward the opening 97. Further, the outer surface of the nozzle section 93 is formed to have a tapered shape toward the opening 97. In other words, the outer surface of the nozzle section 93 is shaped into a truncated cone.

In the embodiment, the inner surface of the nozzle section 93 is constructed of two tapered surfaces. More specifically, the taper ratio on the side of the end portion (forward end portion or tip portion) of the nozzle section 93 (on the side closer to the opening 97) is smaller than the taper ratio on the side of the basal end portion of the nozzle section 93 (on the side closer to the shoulder section 92). Namely, the taper angle (cone angle) on the side of the forward end portion of the nozzle section 93 is smaller than the taper angle on the side of the basal end portion of the nozzle section 93. Further, on the side of the basal end portion of the nozzle section 93, the inner surface of the nozzle section 93 is continued to the inner circumferential surface of the shoulder section 92 defining the through hole 96. Namely, the taper ratio on the side of the basal end portion of the nozzle section 93 is substantially same as the taper ratio in the inner circumferential surface of the shoulder 92 defining the through hole 96.

A plurality of ribs 98 are provided on the outer surface of the nozzle section 93; the ribs 98 protrude outwardly in the radial direction of the nozzle section 93 and extend in a direction in which the nozzle section 93 protrudes. In the embodiment, the ribs 98 are formed in the outer surface of the nozzle section 93 at four locations at 90-degree intervals in the circumferential direction of the nozzle section 93. Further, the diameter of a circle connecting the protruding end portions (forward or tip portions) of the four ribs 98 is greater than the diameter of the inlet 112. On the other hand, the dimension of the outer diameter of the end portion of the nozzle section 93 is smaller than the diameter of the inlet 112.

Figure 8:
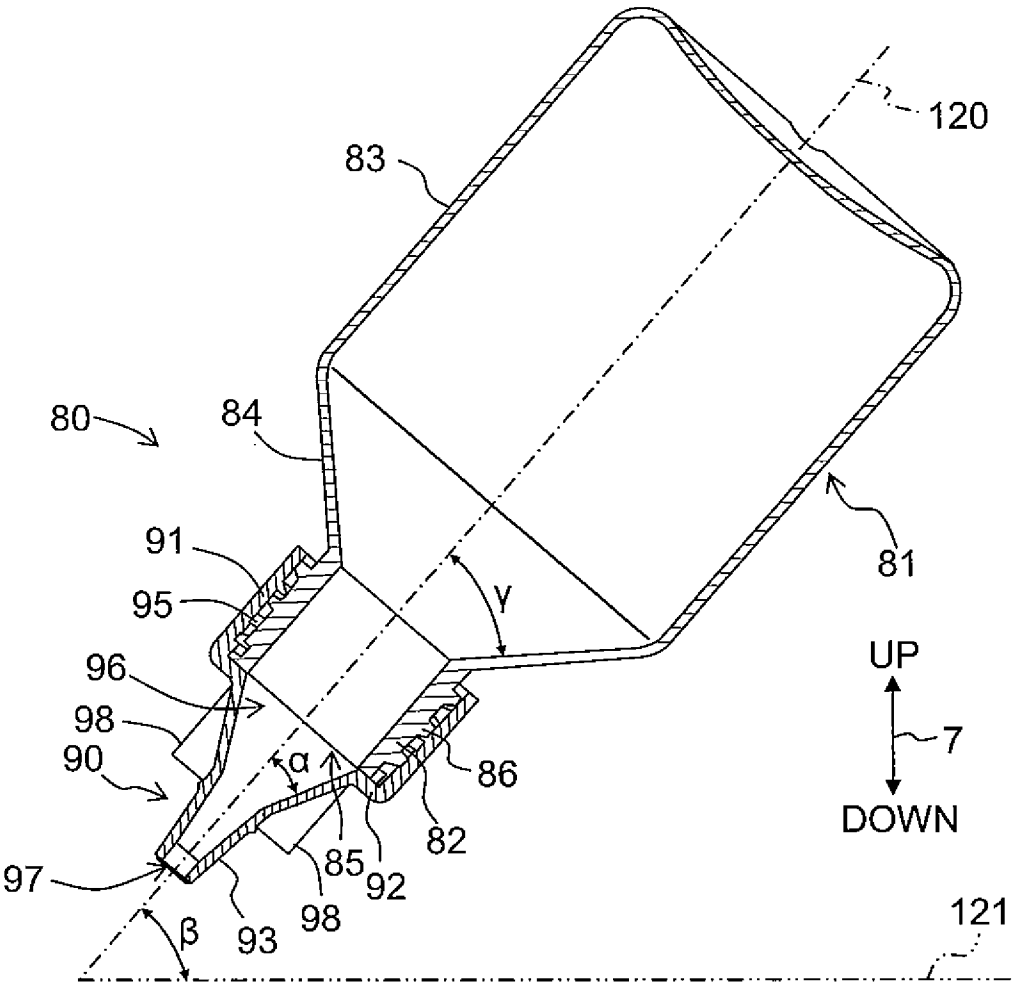
FIG. 8 is a cross-sectional view depicting the bottle 80 in the pouring posture in the plane surface including the normal line 120.
Figure 9:
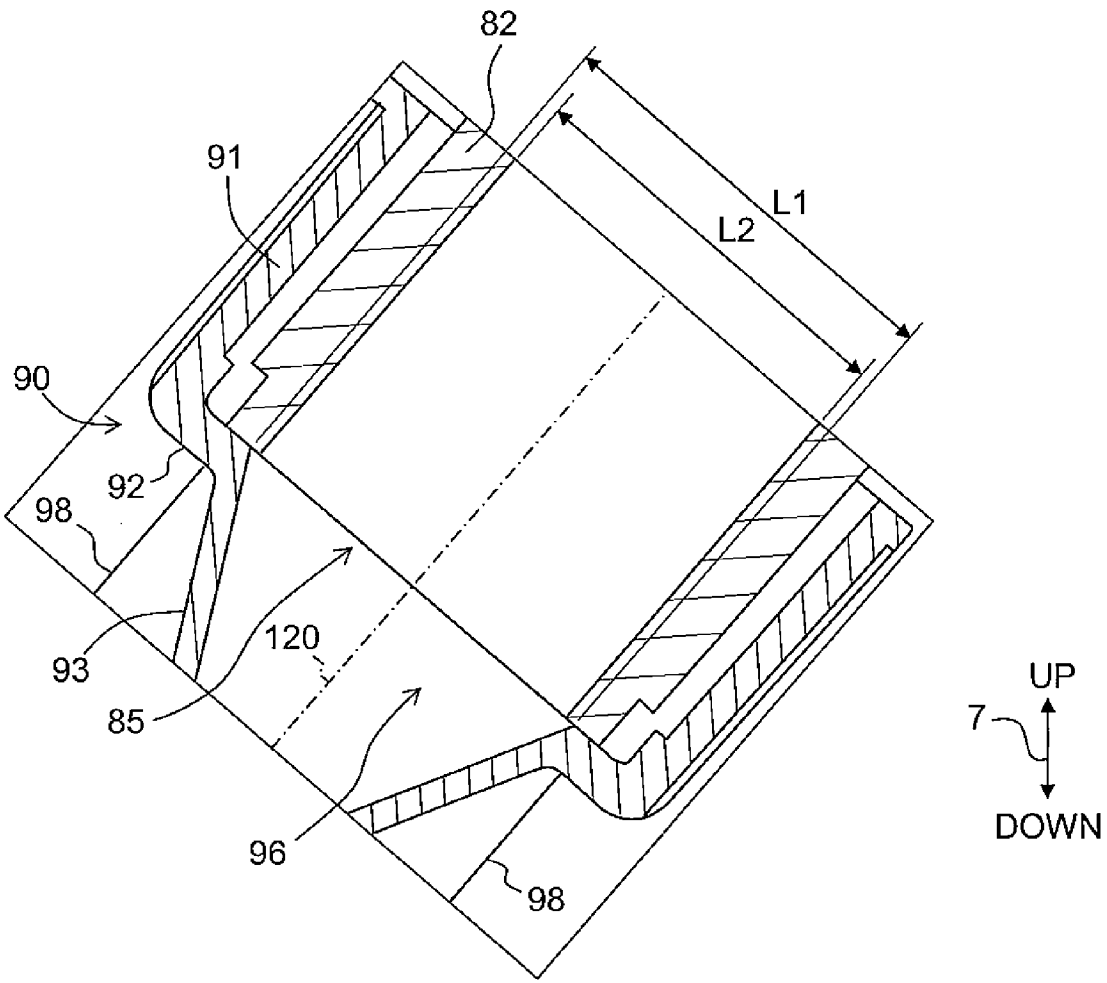
FIG. 9 is an enlarged cross-sectional view depicting a connecting location at which the bottle body 81 and the nozzle 90 are connected.
Figure 10:
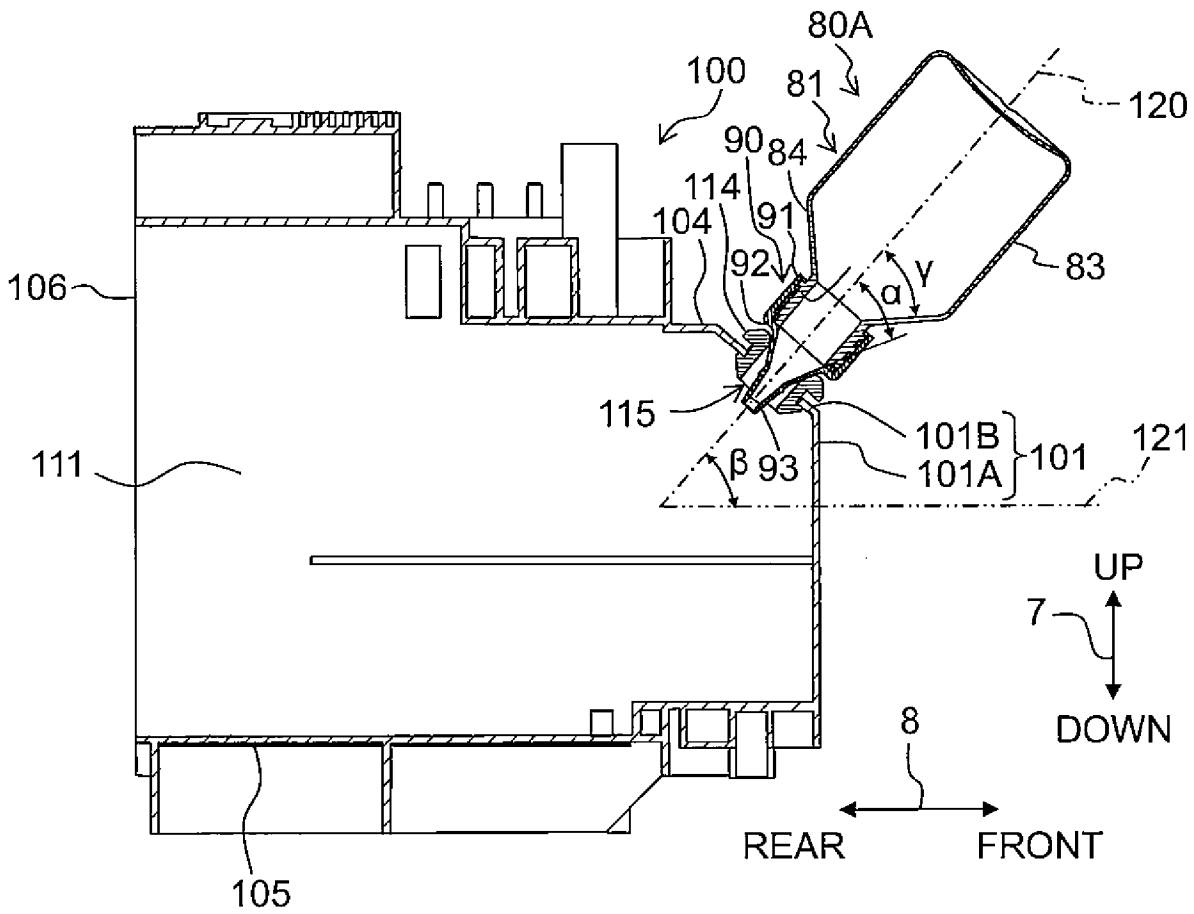
FIG. 10 is a cross-sectional view depicting a bottle 80A and an ink tank 100 of a modification, and corresponding to those depicted in FIG. 7.

The cap 94 is configured to be detachable and attachable with respect to the end portion of the nozzle section 93. The cap 94 installed in the end portion of the nozzle section 93 closes (blocks) the opening 97. With this, the ink stored in the bottle body 81 is prevented from flowing to the outside of the bottle 80 via the opening 97. On the other hand, when the cap 94 is detached (removed) from the end portion of the nozzle section 93, the ink stored in the bottle body 81 can flow to the outside of the bottle 80 via the opening 97. Further, the cap 94 is connected to the trunk section 91 by an elastically deformable connection section 99. In FIGS. 8 to 10, the cap 94 is omitted in the drawings.

In the bottle 80 having the above-described configuration, when the male thread 86 formed in the small diameter section 82 is engaged with the female thread 95 formed in the trunk section 91, the nozzle 90 is installed in the bottle body 81. In this situation, the end portion of the small diameter section 82 defining the opening 85 is brought into contact with the shoulder section 92, as depicted in FIGS. 8 and 9. With this, any leakage of the ink from the connecting (attaching) location at which the bottle body 81 and the nozzle 90 are connected.

<Operation for Pouring the Ink to the Ink Tank 100>

Figure 7:
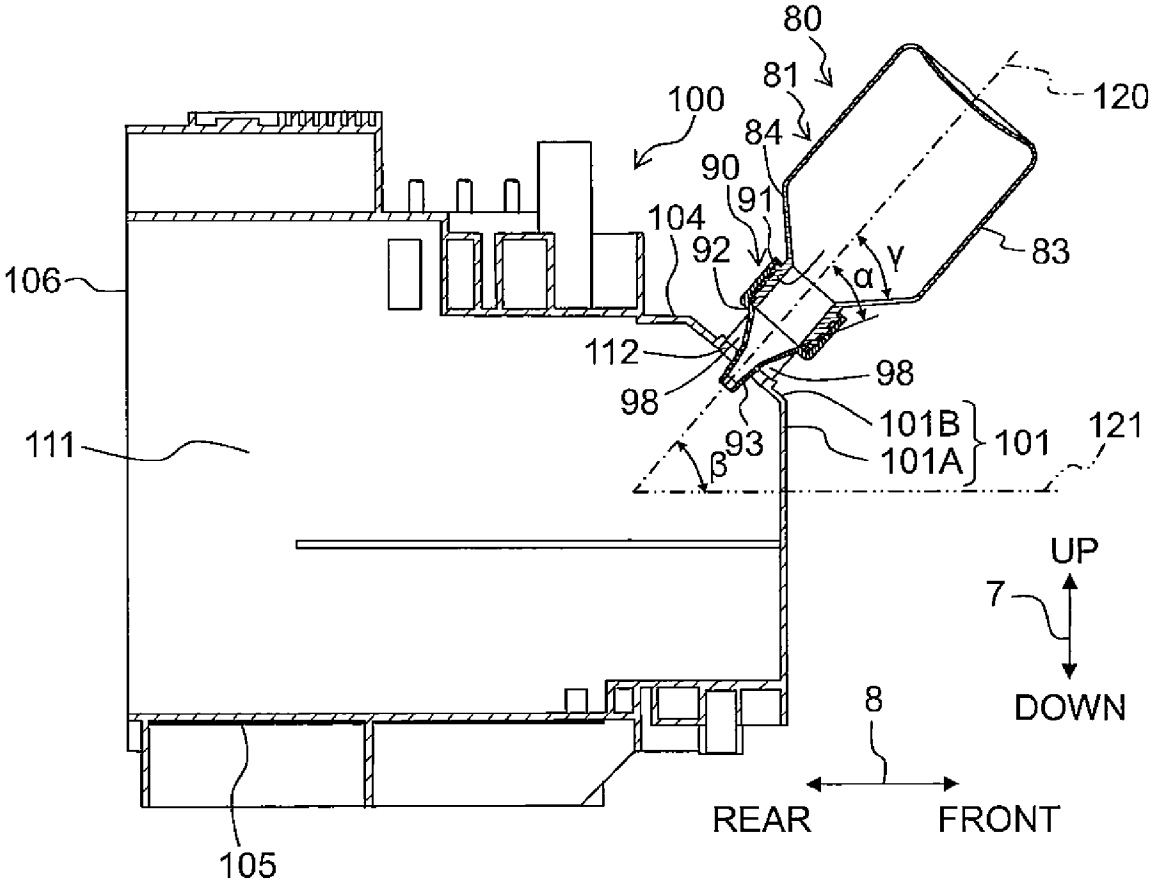
FIG. 7 is a cross-sectional view depicting the bottle 80 in a pouring posture in a plane surface including a normal line 120, and the ink tank 100.

At first, the multi-function periphery 10 is allowed to assume the usable posture, and the cap 113 is removed from the inlet 112. Further, the cap 94 is removed from the end portion of the nozzle section 93. Next, as depicted in FIG. 7, the end portion, of the nozzle section 93, in an ink outflowing direction in which the ink is allowed to outflow (the end portion of the nozzle section 93 formed with the opening 97) is inserted into the ink chamber 111 via the inlet 112. In this situation, the end portions of the ribs 98 provided on the outer surface of the nozzle section 93 are brought into contact with the periphery of the inlet 112, thereby positioning the nozzle section 93 relative to the inlet 112. The posture of the bottle body 81 in this situation is an example of the pouring posture.

The ink inside the bottle 80 in the pouring posture is allowed to flow out of the bottle 80 into the ink chamber 111 via the opening 97. Namely, the ink inside the bottle body 81 is allowed to flow out to the ink chamber 111 by the gravity. More specifically, the ink inside the bottle body 81 is allowed to flow out from the opening 97 after flowing on the inner surface of the large diameter section 83, the inner surface of the inclined section 84, the inner surface of the small diameter section 82, the inner surface of the shoulder section 92, and the inner surface of the nozzle section 93.

Here, in the bottle 80 in the pouring posture, an angle $\alpha$ which is defined between the normal line 120 of the inclined wall 101 and the inner surface of the nozzle section 93 as viewed from the lower side in the vertical direction is smaller than an angle $\beta$ defined between the normal line 121 and the horizontal line 121, as depicted in FIG. 8. More specifically, in a case that the angle $\beta$ defined between the normal line 120 and the horizontal line 121 is in a range of 40 degrees to 90 degrees, the angle $\alpha$ defined between the normal line 120 and the inner surface of the nozzle section 93 is preferably in a range of 20 degrees to 40 degrees, more preferably in a range of 30 degrees to 35 degrees. With this, in the bottle 80 in the pouring posture, the inner surface of the nozzle section 93 is inclined downward toward the opening 97. Note that in the example depicted in FIG. 8, although the angle defined between the normal line 120 and the tapered surface of the nozzle section 93 on the basal end thereof, as viewed from the lower side in the vertical direction, is defined as the angle $\alpha$, the above-described relationship also holds for an angle defined between the normal line 120 and the tapered surface of the nozzle section 93 on the distal end (forward or tip end portion) of the nozzle section 93, as viewed from the lower side in the vertical direction.

Further, in the bottle 80 in the pouring posture, an angle $\gamma$ defined between the normal line 120 and the inner surface of the inclined section 84 as viewed from the lower side in the vertical direction is smaller than the angle $\beta$ defined between the normal line 120 and the horizontal line 121, as depicted in FIG. 8. More specifically, an angle ($\beta$-$\gamma$) defined between the horizontal line 121 and the inner surface of the inclined section 84 is preferably in a range of 1 degree to 5 degrees, more preferably in a range of 2 degrees to 4 degrees. With this, in the bottle 80 in the pouring posture, the inner surface of the inclined section 84 is inclined downward toward the opening 97.

Further, in the bottle 80 in the pouring posture, an inner diameter dimension L1 of the inner diameter of a portion, of the nozzle 90, located at a horizontal position at which the inner circumferential surface becomes horizontal, is not less than an inner diameter dimension L2 of inner diameter of the end portion of the small diameter section 82 defining the opening 85, as depicted in FIG. 9. More preferably, the minimum permissible dimension of the inner diameter dimension L1 is greater than the maximum permissible dimension of the inner diameter dimension L2. With this, a portion which is included in the end portion of the small diameter section 82 defining the opening 85 and which is located on the outer side in the radial direction of the small diameter section 82 is brought into contact with the shoulder section 92, and another portion included in the end portion of the small diameter section 82 defining the opening 85 and which is located on the inner side in the radial direction of the small diameter section 82 is located at an inner side than the inner circumferential surface of the shoulder section 92 defining the through hole 96.

Note that in the embodiment, the position of the inner diameter dimension L1 is the boundary position between the surface of the shoulder section 92 brought into contact with the end portion of the small diameter section 82 and the inner circumferential surface of the shoulder section 92 defining the through hole 96. In other words, the inner diameter dimension L1 in the embodiment corresponds to the maximum diameter of the through hole 96. Further, in other words, the inner diameter dimension L1 in the embodiment corresponds to the maximum value of the inner diameter dimension of the nozzle section 93. Further, the position of the inner diameter dimension L2 in the embodiment is located upstream of the position of the inner diameter dimension L1 in an ink flow direction in which the ink is allowed to flow from the bottle 80 toward the ink tank 100.

According to the above-described embodiment, in the pouring posture of the bottle 80, the inner surface of the nozzle section 93 is inclined downward in the direction from the bottle 80 toward the ink tank 100, and the inner surface of the inclined section 84 is inclined downward in the direction from the bottle 80 toward the ink tank 100. As a result, the flow of the ink from the bottle 80 toward the ink tank 100 can be made smooth.

Further, according to the embodiment, by making the inner diameter dimension L1 be not less than the inner diameter dimension L2, the formation of any recessed portion which might become an ink accumulating portion is suppressed between the bottle body 81 and the nozzle 90. Furthermore, by making the minimum permissible dimension of the inner diameter dimension L1 be greater than the maximum permissible dimension of the inner diameter dimension L2, any recessed portion which might become an ink accumulating portion is prevented from being formed between the bottle body 81 and the nozzle 90 even in a case that there is any variation in dimension due to any manufacturing error or the like. As a result, it is possible to make the flow of the ink from the bottle 80 toward the ink tank 100 be more smooth.

<Modification>

With reference FIG. 10, a bottle 80A and an ink tank 100 according to a modification will be explained. Note that, however, any detailed explanation regarding the common points or features with the above-described embodiment will be omitted, and the following explanation will be focused on the difference between the embodiment and the modification. The bottle 80A according to the modification is different from that of the embodiment in that the ribs 98 are omitted in the bottle 80A; the remaining parts or components of the bottle 80A are common with those of the embodiment. Further, the ink tank 100 according to the modification is different from that of the embodiment in that a holding member 114 is further provided on the ink tank 100 of the modification.

As depicted in FIG. 10, the holding member 114 is a substantially annular-shaped member having a through hole 115 penetrating through the holding member 114 in a direction of the thickness thereof. Further, the holding member 114 is formed of an elastically deformable material. Furthermore, the dimension of outer diameter of the holding member 114 is greater than the diameter of the inlet 112. Moreover, the holding member 114 is attached to the periphery of the inlet 112 in a state that the diameter of the holding member 114 is elastically reduced or compressed. Then, the nozzle section 93 in the modification is inserted into the through hole 115 of the holding member 114. In this situation, the holding member 114 is elastically deformed in a direction in which the diameter of the through hole 115 is expanded or increased, and is brought into contact with the outer surface of the nozzle section 93.

According to the above-described modification, the bottle 80A is maintained in the pouring posture by the holding member 114. As a result, especially in a case that a large amount of the ink is stored inside the bottle body 81, it is possible to suppress such a situation that the bottle 80 is inclined and thereby causes the inner surface of the nozzle section 93 and the inner surface of the inclined section 84 become closer to the horizontal line 121.

Further, in the above embodiment, although the explanation has been given about the ink as an example of the liquid, the present teaching is not restricted to this. Namely, instead of the ink, the liquid may be a pretreatment liquid which is to be discharged onto a recording paper before jetting an ink at the time of printing, or may be water, etc. which is to be sprayed in the vicinity of the nozzles 40 of the recording head 39 for preventing drying of the nozzles 40 of the recording head 39. Note that the present teaching is particularly effective in a case that the present teaching is applied to a liquid consuming apparatus provided with a tank storing a colored liquid.

What is claimed is:

1. A set of tank and bottle comprising:

a tank including a liquid chamber, an inclined wall defining an part of the liquid chamber and inclined relative to a vertical direction, and an inlet formed in the tank penetrating through the inclined wall; and a bottle including a bottle body including a first opening formed in an end portion of the bottle body, and a nozzle configured to be in an attached state to the end portion of the bottle body;

wherein the nozzle includes:

a shoulder section including a contact portion configured to brought into contact with the end portion of the bottle body in the attached state, the shoulder section extending toward an inner side in a radial direction of the first opening of the bottle body; and a nozzle section protruding from an end of the portion of the shoulder section, the nozzle section including an inner surface of which an inner diameter is decreased continuously in a direction away from the shoulder section; and wherein in a pouring posture of the bottle in which the nozzle section inserted into the inlet is positioned at a periphery of the inlet, an angle defined between a normal line of the inclined wall and an inner surface of the nozzle section is smaller than an angle defined between the normal line and a horizontal line.

2. The set of tank and bottle according to claim 1, wherein the angle defined between the normal line and the inner surface of the nozzle section is in a range of 20 degrees to 40 degrees.

3. The set of tank and bottle according to claim 1, wherein an inner diameter of a portion, of an inner circumferential surface of the nozzle, located at a horizontal position at which the inner circumferential surface becomes horizontal in the pouring posture is not less than an inner diameter of the end portion of the bottle body defining the first opening.

4. The set of tank and bottle according to claim 3, wherein the inner diameter of the portion, of the inner circumferential surface of the nozzle, located at the horizontal position at which the inner circumferential surface becomes horizontal in the pouring posture is an inner diameter of the inner circumferential surface of the nozzle section at a boundary position between a surface of the shoulder section brought into contact with the end portion of the bottle body and an inner circumferential surface of the shoulder section defining a through hole formed in the shoulder section.

5. The set of tank and bottle according to claim 3, wherein a minimum permissible dimension of the inner diameter of the portion of the nozzle located at the horizontal position at which the inner circumferential surface becomes horizontal in the pouring posture is greater than a maximum permissible dimension of the inner diameter of the end portion of the bottle body defining the first opening.

6. The set of tank and bottle according to claim 1, wherein the shoulder section is formed with a hole facing the first opening in the attached state, the shoulder section further includes an inner surface which defines the hole and connected to the inner surface of the nozzle section, and a taper ratio of the inner surface of the nozzle section is substantially same as the taper ratio in the inner surface of the shoulder section.

7. The set of tank and bottle according to claim 1, wherein the bottle body includes:

a small diameter section defining the first opening;

a large diameter section of which inner diameter is greater than that of the small diameter section; and an inclined section disposed between the small diameter section and the large diameter section and inclined such that an inner diameter of the inclined section is decreased continuously from a side of the large diameter section toward a side of the small diameter section; and wherein in the pouring posture, an angle defined between the normal line of the inclined wall and an inner surface of the inclined section is smaller than the angle defined between the normal line and the horizontal line.

8. The set of tank and bottle according to claim 7, wherein an angle defined between the inner surface of the inclined section and the horizontal line is in a range of 1 degree to 5 degrees.

9. The set of tank and bottle according to claim 8, wherein an angle defined between the inclined wall and the horizontal line is less than 45 degrees.

10. The set of tank and bottle according to claim 1, wherein the tank further includes a holding member which is arranged at a location at which the holding member is brought into contact with an outer surface of the nozzle section inserted in the inlet, and which is configured to hold the bottle in the pouring posture.

11. The set of tank and bottle according to claim 1, wherein the nozzle section is formed in a truncated cone shape.

12. The set of tank and bottle according to claim 11, wherein the end portions, of the ribs, on the side of the second opening are brought into contact with the periphery of the inlet of the inclined wall to thereby position the bottle in the pouring posture.

13. The set of tank and bottle according to claim 1, wherein the nozzle section has a plurality of ribs provided on an outer surface of the nozzle section, protruding outwardly in a radial direction of the nozzle section and extending in a direction in which the nozzle section protrudes; and diameter of a circle connecting protruding end portions, of the ribs, on a side of the second opening is greater than diameter of the inlet.

14. The bottle according to claim 1, wherein the shoulder section is formed with a hole facing the first opening in the attached state, the shoulder section further includes an inner surface which defines the hole and connected continuously to the inner surface of the nozzle section, each of a taper ratio of the inner surface of the nozzle section and a taper ratio of the inner surface of the shoulder section has a first taper ratio.

15. A bottle configured to allow a liquid to be poured therefrom into a tank including liquid chamber, an inclined wall defining an part of the liquid chamber and inclined relative to a vertical direction, and an inlet formed in the tank penetrating through the inclined wall, the bottle comprising:

a bottle body including a first opening formed in an end portion of the bottle body; and a nozzle configured to be in an attached state to the end portion of the bottle body;

wherein the nozzle includes:

a shoulder section including a contact portion configured to brought into contact with the end portion of the bottle body, the shoulder section extending toward an inner side in a radial direction of the first opening of the bottle body; and a nozzle section protruding from an end of the portion of the shoulder section, the nozzle section including an inner surface of which an inner diameter is decreased continuously in a direction away from the shoulder, wherein in a pouring posture of the bottle in which the nozzle section inserted into the inlet is positioned at a periphery of the inlet, an angle defined between a normal line of the inclined wall and an inner surface of the nozzle section is smaller than an angle defined between the normal line and a horizontal line.

16. The bottle according to claim 15, wherein the bottle body includes:

a small diameter section defining the first opening;

a large diameter section of which inner diameter is greater than that of the small diameter section; and an inclined section disposed between the small diameter section and the large diameter section and inclined such that an inner diameter of the inclined section is decreased continuously from a side of the large diameter section toward a side of the small diameter section.

17. The bottle according to claim 15, wherein the nozzle section is formed in a truncated cone shape.

18. The bottle according to claim 15, wherein the nozzle section has a plurality of ribs provided on an outer surface of the nozzle section, protruding outwardly in a radial direction of the nozzle section and extending in a direction in which the nozzle section protrudes; and diameter of a circle connecting protruding end portions, of the ribs, on a side of the second opening is greater than diameter of the inlet.

19. The bottle according to claim 15, wherein the end portion of the bottle body includes a small diameter section of which tip end defines the first opening, an inner diameter of the tip end of the small diameter section is not less than an inner diameter of the inner circumferential surface of the nozzle section at a boundary position between a surface of the shoulder section brought into contact with the end portion of the bottle body and an inner circumferential surface of the shoulder section defining a through hole formed in the shoulder section.

20. The bottle according to claim 15, wherein the shoulder section is formed with a hole facing the first opening in the attached state, the shoulder section further includes an inner surface which defines the hole and connected to the inner surface of the nozzle section, and the inner surface of the shoulder section and a taper ratio of the inner surface of the nozzle section is substantially same as the taper ratio in the inner surface of the shoulder section.

* * * * *